US006923367B1

(12) United States Patent
Grossman et al.

(10) Patent No.: US 6,923,367 B1
(45) Date of Patent: Aug. 2, 2005

(54) SAFETY MAILBOX

(76) Inventors: David Grossman, 1408 Bayshire La., Hernodon, VA (US) 20170; Robert Schumann, 11723 Quay Rd., Oakton, VA (US) 20124

( * ) Notice: Subject to any disclaimer, the term of this patent is extended or adjusted under 35 U.S.C. 154(b) by 0 days.

(21) Appl. No.: 10/274,973

(22) Filed: Oct. 22, 2002

Related U.S. Application Data

(60) Provisional application No. 60/330,636, filed on Oct. 26, 2001, provisional application No. 60/330,605, filed on Oct. 25, 2001, provisional application No. 60/330,503, filed on Oct. 23, 2001.

(51) Int. Cl.[7] ..... B65D 91/00
(52) U.S. Cl. ..... 232/17; 232/29; 232/38; 422/24; 34/275

(58) Field of Search ..... 232/17, 45, 29, 232/33, 38; 422/24; 34/250; 250/455.11, 250/492.1

(56) References Cited

U.S. PATENT DOCUMENTS

| | | | | |
|---|---|---|---|---|
| 3,107,848 | A * | 10/1963 | Penta | 232/17 |
| 5,425,501 | A * | 6/1995 | Wesorick | 232/17 |
| 5,521,578 | A * | 5/1996 | DelValle | 340/330 |
| 6,474,543 | B2 * | 11/2002 | Grell | 232/38 |

* cited by examiner

*Primary Examiner*—William L. Miller
(74) *Attorney, Agent, or Firm*—David G. Grossman

(57) ABSTRACT

A safety mailbox system including a mailbox container integrated with at least one decontaminating mechanism is disclosed. Contaminants may include chemical and biological agents.

9 Claims, 10 Drawing Sheets

SAFETY MAILBOX

CROSS REFERENCE TO RELATED APPLICATIONS

This application claims benefit to the following provisional patent applications which are hereby incorporated by reference.

Application No. 60/330,503 to Grossman, filed on Oct. 23, 2001 and entitled "Neutralizing Biological Agents in a Mailbox."

Application No. 60/330,636 to Grossman, filed on Oct. 26, 2001 and entitled "Decontamination Mailbox."

Application No. 60/330,605 to Grossman et al., filed on Oct. 25, 2001 and entitled "Safety Mailbox."

BACKGROUND OF THE INVENTION

The present invention relates to decontaminating mail in a mailbox. More specifically, the present invention provides for removing or neutralizing pathogens residing on, in, or about objects placed in a mail container. Pathogens may be chemical or biological.

During September and October of 2001, terrorist sent mail contaminated with the biological agent Anthrax through the postal service to individuals and organizations. Consequently, several people became ill and several others died from exposure to this biological agent. Many people have become afraid for their own safety and the safety of their friends, associates, and love ones. What is needed is a means for individuals or organizations to minimize their risk of illness due to exposure to contaminated mail.

BRIEF SUMMARY OF THE INVENTION

One advantage of the present invention is that it may decontaminate contents placed into a mailbox by a first party before the second party removes the same contents.

Another advantage of this invention is that it may be adapted to preexisting mailboxes or other containers.

A further advantage of this invention is that it allows a user to develop a sense of individual security about becoming contaminated from their mail without relying on outside services.

Yet a further advantage of this invention is that a multitude of different decontamination methods may be implemented either individually or in concert.

To achieve the foregoing and other advantages, in accordance with all of the invention as embodied and broadly described herein, a decontamination mailbox including a mail chamber having a top and at least one door, and at least one decontamination device.

In yet a further aspect of the invention, a decontamination mailbox wherein the top of the mail chamber is composed of a translucent material, the translucent material acting as a decontamination device.

In yet a further aspect of the invention, a decontamination mailbox wherein at least one of the decontamination devices is an optical lens. The optical lens may be a fresnel lens.

In yet a further aspect of the invention, a decontamination mailbox wherein at least one of the decontamination devices includes an artificial light source. The artificial light may be powered in part by solar cells.

In yet a further aspect of the invention, a decontamination mailbox wherein decontamination devices may include an irradiator, a steam generator, a vacuum, an electromagnetic generator. Any of the decontamination devices may be controlled by a decontamination controller. The decontamination controller may provide status information to a user.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
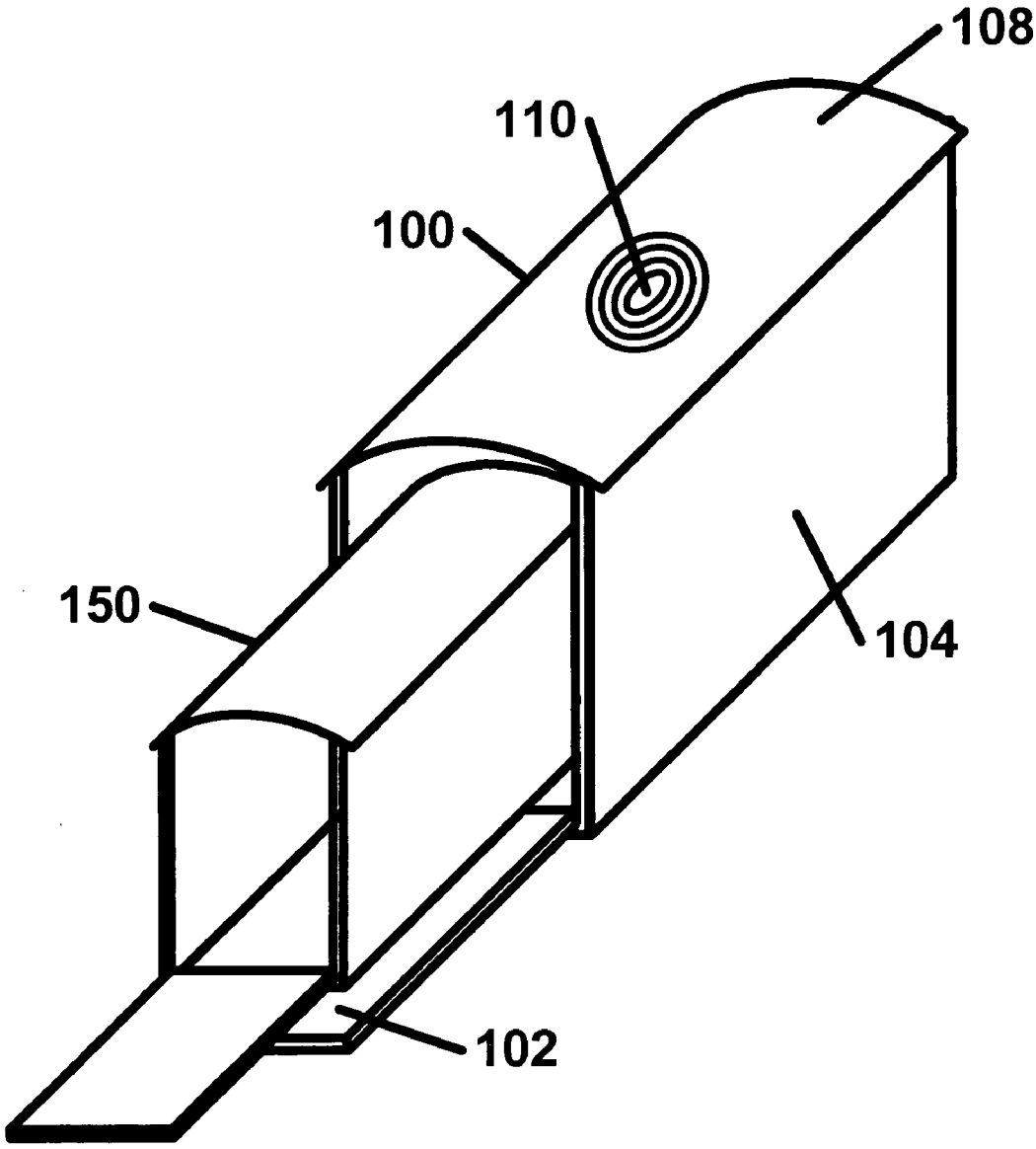
FIG. 1 shows an embodiment of a safety mailbox system.

The present invention is a safety mailbox including a detachable mailbox that may be used in conjunction with a processing system. The processing system may employ one or more decontaminating mechanism. The processing system may also allow a user to view or manipulate mail in the detachable mailbox before exposing themselves to any contamination risks. A detachable mailbox may be a mailbox container. Contaminants may be pathogens and biological agents including spore forming bacteria such as anthrax, viruses, or other biological disease forming agents such as small pox, botulism, the plague, hantavirus. Some of these contaminants may be distributed by mail. The safety mailbox system may allow individuals or organizations to minimize their risk of illness due to exposure to contaminated mail by containing the mail in an the safety mailbox system until the mail is deemed safe to remove. The mail placed inside the detachable mailbox may be subjected to decontamination mechanisms to decontaminate or neutralize pathogens located in, on, or around mail deposited in the detachable mailbox.

Mail may be letters, packages, or other materials capable of being sent through any package delivery service such as the postal service, Federal Express, or United Parcel service. A mail chamber may be any container capable of holding mail including a processing system, a mailbox, a detachable mailbox, an outer mailbox, a bag or a mailbox insert.

Decontamination mechanisms may include treating contaminants with light, heating contaminants, cooling contaminants, treating contaminants with chemicals, treating contaminants with antibiotic agents, filtration of contaminants, vacuuming contaminants, dehumidifying contaminants, subjecting contaminants to electromagnetic radiation, subjecting contaminants to radioactive radiation including the process of irradiation, or subjecting contaminants to magnetic fields.

The Detachable Mailbox and Processing System

A safety mailbox system may include a detachable mailbox 150 and a processing system 100, where the detachable mailbox 150 is positionable within the processing system 100. The processing system 100 may include at least one decontamination device.

A portion of the detachable mailbox 150 or the processing system 100 may be composed of a translucent or clear material. An advantage of using a translucent or clear material is to allow light processing of mail while mail is in either the detachable mailbox 150 or the processing system 100. Another advantage of using translucent or clear material is to allow visual inspection of the interiors of either the detachable mailbox 150 or the processing system 100. The translucent material passes ultraviolet light.

Any of the containers capable of holding mail including a mailbox or processing system may include a mail manipulation system. A mail manipulation system may include the use of gloves that insulate a user from the mail. The gloves may be attached to the walls of the mail holding container. Other mail manipulation systems may include the use of robotics or mechanical manipulation.

A detachable mailbox may interoperable with the processing system. The detachable mailbox may even operably mate with the processing system. For example, a detachable mailbox when inserted into a processing system will mate to decontamination devices.

The detachable mailbox may include a means for attaching the detachable mailbox to a detachable mailbox support. The detachable mailbox support may be a post, a mounting plate, or any other object capable of supporting the detachable mailbox. Any reasonable means for attaching the detachable mailbox to a detachable mailbox support may be used, including but not limited to bands, glue, clips, screws, buckles, Velcro, latches, and locks.

Using an Outer Mailbox

The present invention may further include an outer mailbox having an outer mailbox door. The detachable mailbox may also include a detachable mailbox door. The detachable mailbox may be positionable within the outer mailbox. Preferably the outer mailbox door may be operable in conjunction with the detachable mailbox door. This would allow the detachable mailbox door and the outer mailbox door to selectively operate either in unison, or individually. When mail is to be deposited into the detachable mailbox, a user may open both doors either individually or in unison to gain access to the inside of the detachable mailbox. When the detachable mailbox is to be removed, a user need only open the outer mailbox door, thereby allowing the mail contained inside the detachable mailbox to be kept in isolation.

It is possible to have alternative mechanisms to deposit mail into both the detachable and outer mailboxes. These alternate mechanisms may include doors, slots, self sealing slots, or tubes. Preferably, these alternate mechanisms interoperate to allow mail to be deposited from outside both the detachable mailbox and the outer mailbox in a unified operation.

Any means known to those in the art may be used for connecting the outer mailbox door to the detachable mailbox door including connecting the outer mailbox door to the detachable mailbox door with a latch, with a magnet, with Velcro, with a clip, or with a lock.

In another embodiment of the present invention, the detachable mailbox may be a bag having a bag opening positionable inside the outer mailbox. Preferably, the bag is positioned so that the bag opening is positioned inside the outer mailbox so that mail may be deposited into the bag through the bag opening. It is also preferred that the bag opening may be sealed while the bag in positioned inside the outer mailbox. Means for sealing the bag while the bag is positioned inside the outer mailbox may include using a mechanical manipulator, a drawstring, glue, a clip, heat sealant, rubber bands, or a sealing strip.

Treating Contaminants with Light

Some frequencies of light such as ultra-violet (UV) or infrared light (IR) may be used to reduce pathogen numbers. Light may be generated in several ways including lasers, florescent bulbs, neon type tubes, resistive bulbs such as incandescent bulbs, and natural light such as sunlight. For example, a laser may be positioned to expose the mail to UV light. Lasers may be solid state, gas or filter based.

FIG. 1 shows an aspect of an embodiment of a processing system 100 using light process decontamination. Parts of processing system 100 may be constructed of a translucent material to allow light energy to enter the processing system 100. This translucent material may be colored to act as a filter to optimize the frequency of the light that is passed into the processing system to filter the entering light. For example, the translucent material may be colored to optimize the passing of ultraviolet (UV) light into the processing system 100. As illustrated, the roof 108 or sides 104 of the processing system 100 may be made of this translucent material. With the door 102 of the processing system 100 closed, the box may heat naturally, by trapping the energy of the light in the decontaminating mailbox. Further, the translucent material may be colored to shade the contents of the processing system from outsiders. In this embodiment, the processing system 100 may be integrated with the detachable mailbox.

A lens 110 may be integrated into the processing system 100 to concentrate the light energy into the processing system 100. This lens 110 may be any type of lens or lenses including discrete lens, an etched lens, or a molded lens. The lens 110 may be a multitude of lens. One possibility includes integrally molding at least one lens 110 into the processing system structure. An effective lens may be a fresnel lens. Some fresnel lens may replace the typical curved surface of a conventional lens with a series of concentric grooves molded into a plastic surface. In effect, an integrated fresnel lens may merely appear as a surface pattern on the light processing decontamination processing system 100.

Figure 2:
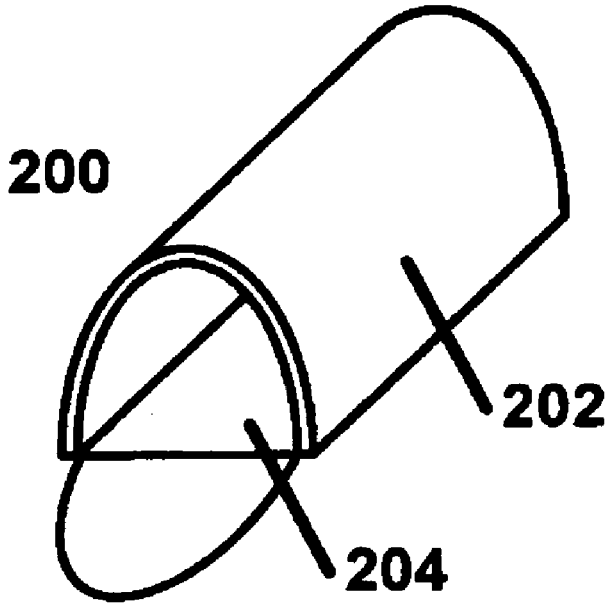
FIG. 2 shows an embodiment of a safety mailbox system.

FIG. 2 shows another embodiment of a light processing decontamination processing system 200, wherein the sides and top 202 are one piece. An advantage of this embodiment is that roof and sides may be combined. To keep energy inside a processing system 200, parts of the mailbox may be reflective, such as the floor 204.

Figure 3:
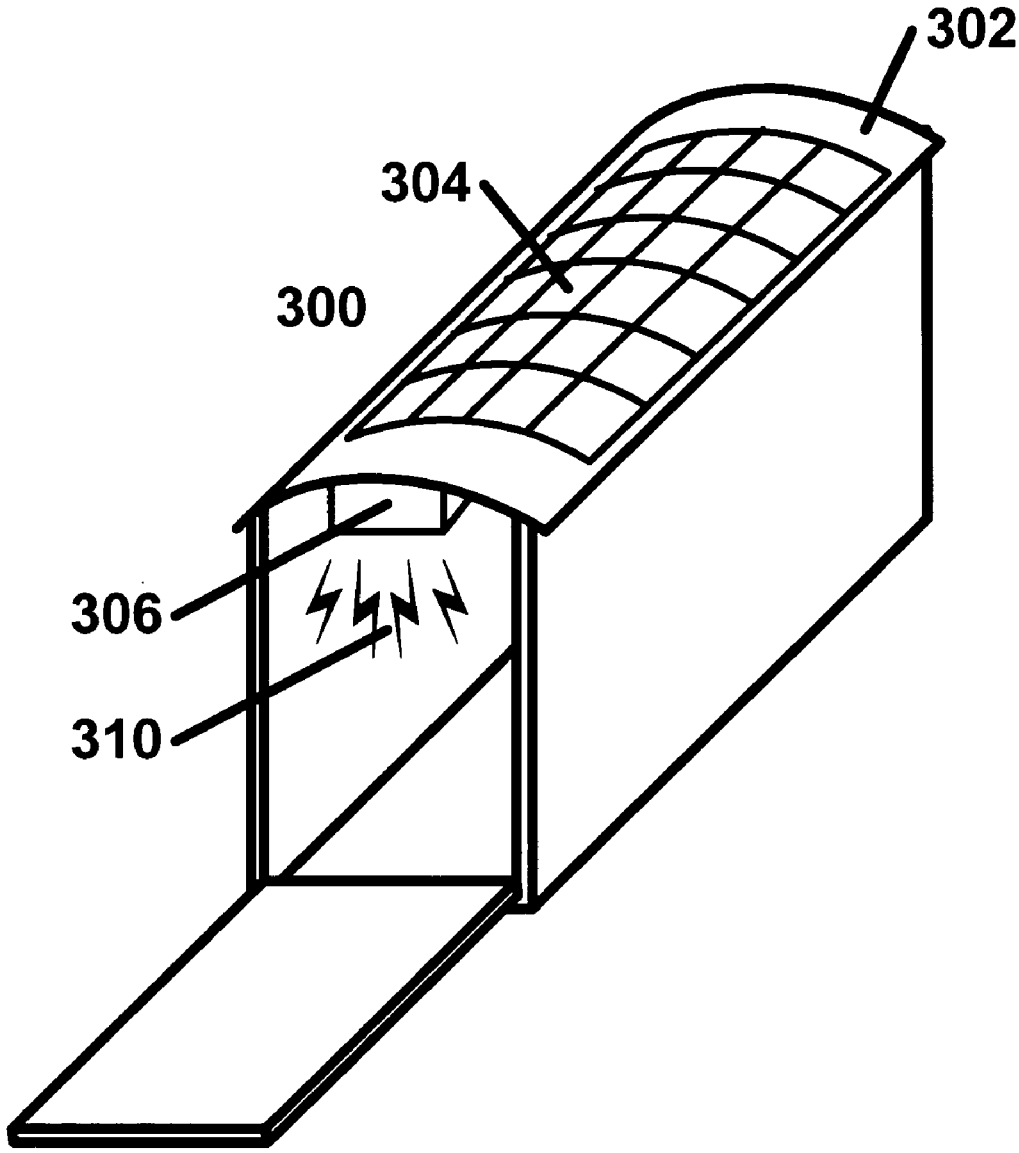
FIG. 3 is an aspect of an embodiment of the present invention using an artificial light source to generate decontamination light.

FIG. 3 is an embodiment of a light processing decontamination processing system 300 using an artificial light source 306 to generate decontamination light 310. This artificial light source may be electric. Electric power sources may include batteries, external power sources, solar power, or some combination. Solar cells 304 may be mounted on the outer surface 302 of the processing system. The solar cells may be used to power the artificial light source 306 directly, charge internal batteries, or both. The batteries may power the internal light source. To maximize the light effect, the artificial light source may run in cycles. The cycles may be triggered by an event such as closing the processing system door, placing mail or a detachable mailboxin the processing system, a timer, or a manual initiation. The artificial light source 306 may further have the added benefit of generating a heat decontamination effect.

Treating Contaminates with Temperature Variations

Subjecting contaminates to temperature variations may also reduce their toxic effects. Temperature variations may include cooling or heating the inside of a processing system. Heat may be generated using wet heat such as steam; or dry heat as may be generated by heating elements or light bulbs. Steam as a decontaminate may be at, above and below atmospheric pressure. Adding organic acid or other chemicals may be added to the steam to increase the decontamination effect. Hot air, water immersion, infrared light, and microwaves are examples of other heat generating sources that may be used. Vacuums, fans, and air-conditioning are examples of cooling mechanisms that may be utilized.

Factors for choosing which particular decontamination method to implement may include: how each decontamination method changes the appearance and texture of the mail being decontaminated; and how well each decontamination method maximizes contaminate reduction.

Figure 4:
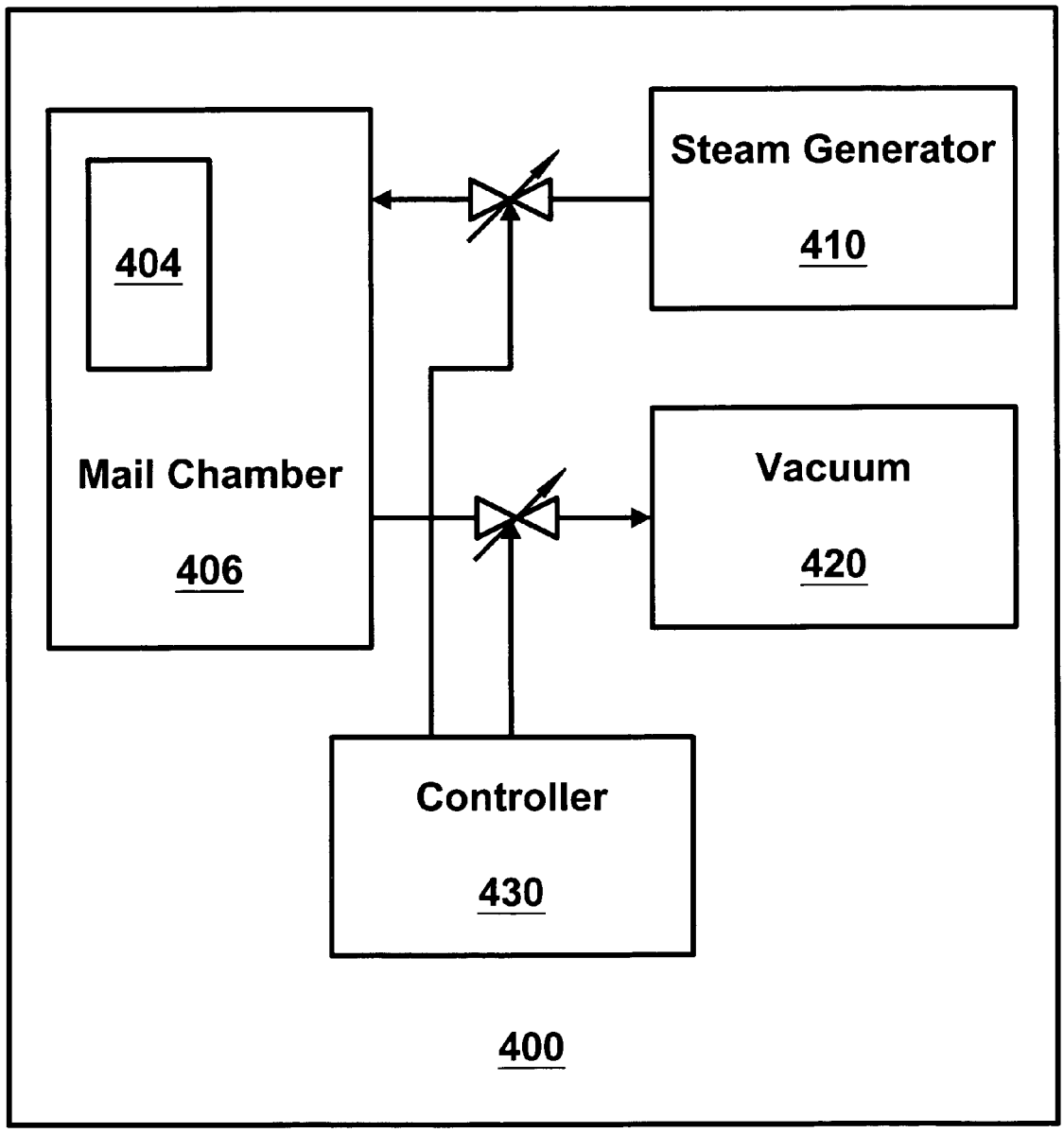
FIG. 4 shows an aspect of an embodiment of a pressurized steam/vacuum cooling processing system.

FIG. 4 illustrates a pressurized steam/vacuum cooling decontamination mailbox 400. Very high rates of temperature rise at the surface of an object may be achieved by condensing steam under pressure. Surface cooking may be avoided by immediately vacuum cooling the object after treatment. The processing system 400 may include a pressure chamber 406, a door 404, a steam generator 410, a vacuum pump 420, and a controller 430. The door 404 of a mailbox may be sealed to allow the mail chamber 406 to pressurize during the steam decontamination treatment.

Figure 5:
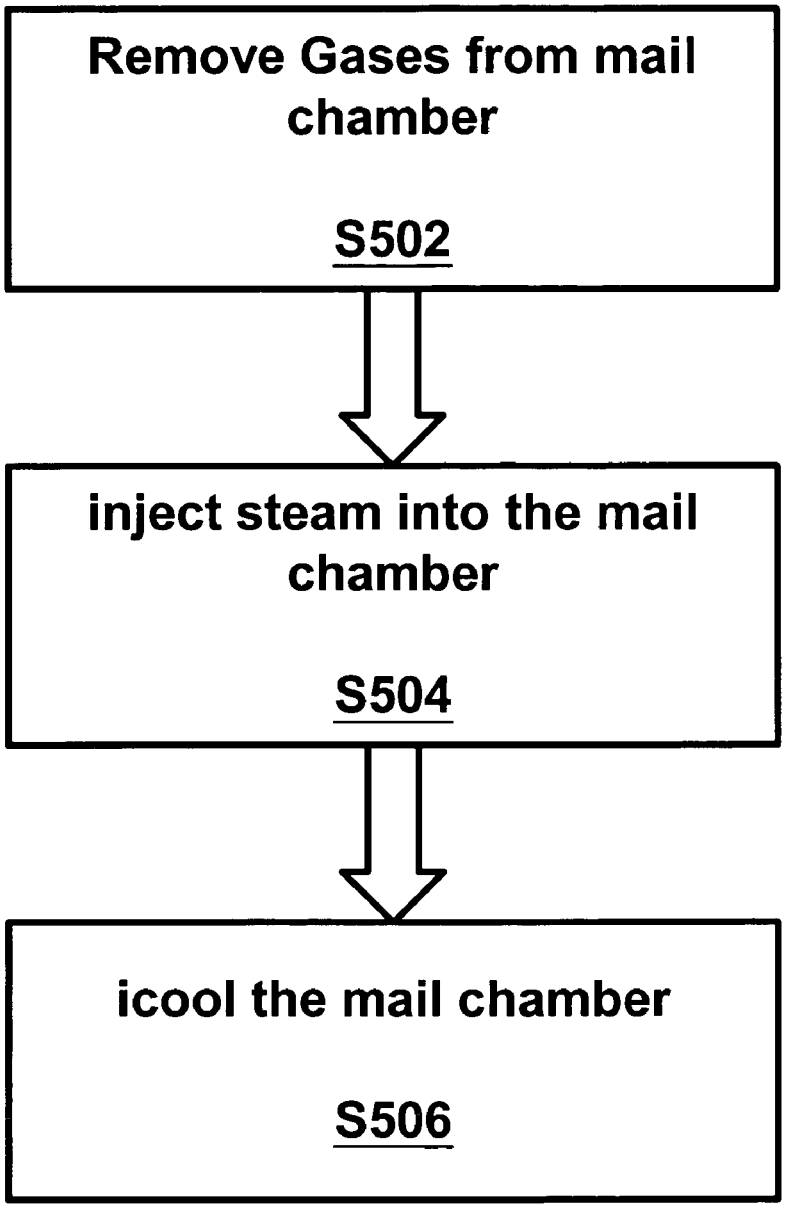
FIG. 5 is a flow diagram of a decontamination cycle as per an aspect of an embodiment of the present invention.

FIG. 5 is a flow diagram of a decontamination cycle as per an aspect of an embodiment of the present invention. After mail is loaded into a processing system, a decontamination cycle may proceed. The contamination cycle may include the steps of removing non-condensable gases from the chamber using the vacuum (S502); introducing steam to the chamber to rapidly increase the surface temperature of the mail (S504); and then cooling the mail (S506). The cooling cycle S506 may be accomplished using a vacuum or other cooling mechanism. This cycle may be initiated automatically when mailbox door is closed, or the cycle may be initiated on a timing cycle, or the cycle may be initiated manually. The timing of each step may be predetermined or may be dynamically modified based on feedback signals such as pressure or temperature. An advantage of dynamically modifying the cycle times may be allowing the cycle time to be minimized, thus reducing any side effects upon the inserted packages.

Figure 6:
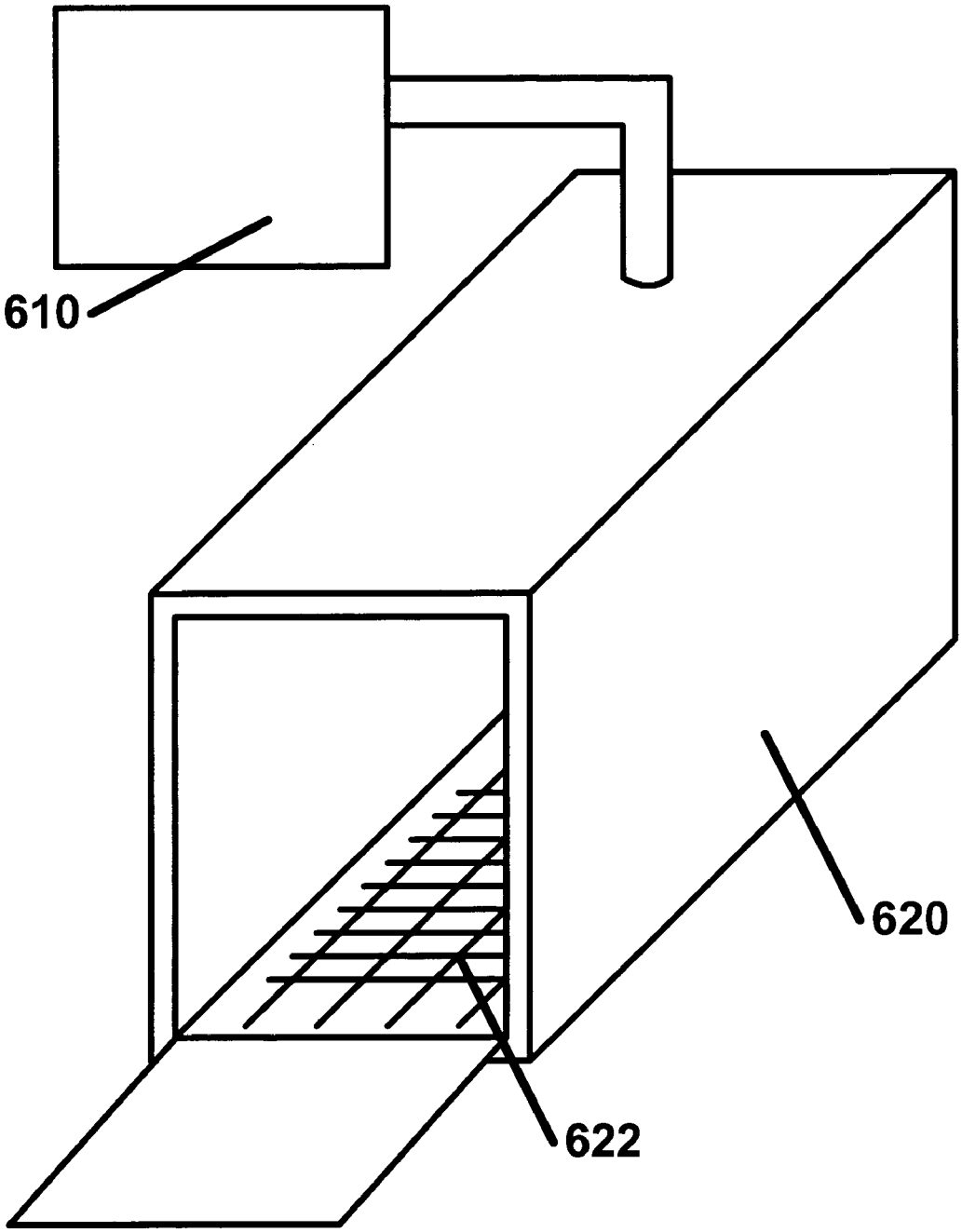
FIG. 6 shows an aspect of an embodiment of the present invention using atmospheric steam decontamination.

Another steam contamination embodiment using atmospheric steam decontamination is shown in FIG. 6. This type of embodiment may likely be less expensive and less difficult to automate than the pressurized steam/vacuum cooling embodiment. An atmospheric steam plant may have much simpler design and operation. In such an embodiment, steam may be generated in a steam plant 610 and continuously fed into the top of a mail chamber 620 having an open bottom 622. As the steam fills the vessel, it may displace air. Since steam is lighter than air, the chamber may fill with steam and the cooler air may exit through the bottom. This system may be initiated either automatically or manually as described earlier. After a set exposure time, the steam may be removed and cooled. It maybe advantageous to provide a door lock that activates while the contents of the chamber are hot.

Yet another embodiment of the present invention may use sub atmospheric steam decontamination. Using this method, mail may be decontaminated at temperatures lower than 100° C. In use, the mail may be placed on a rack in the mailbox. When the door of the mailbox is closed, non-condensable gases may be removed. This removal may be accomplished by use of a vacuum. Steam may then introduced and the desired temperature maintained by controlling the vacuum pressure within the chamber. After the mail is treated for a treatment time, the steam source may be shut off and the packages allowed to cool. Cooling may be accelerated using a cooling means such as vacuum cooling.

Treating Contaminants with Chemicals

Other methods of decontamination include treating the mail in the decontamination mailbox with chemicals. Examples of such chemicals that may be used to treat mail include organic acid, non-organic acid, hot water, sodium hydroxide, chloramine solutions, water solutions of soda, chlorine, anti-bacterial agents, disinfectants, and bleach. Chemicals at any desired concentration may be applied by numerous methods including spraying the chemicals into the chamber. When combining this method with other decontamination methods, it may be preferable that this method is performed separately. For example, if this method is combined with one of the previously described stream methods, it may be preferable if all of the steam is evacuated from the chamber before chemical processing commences.

Figure 7:
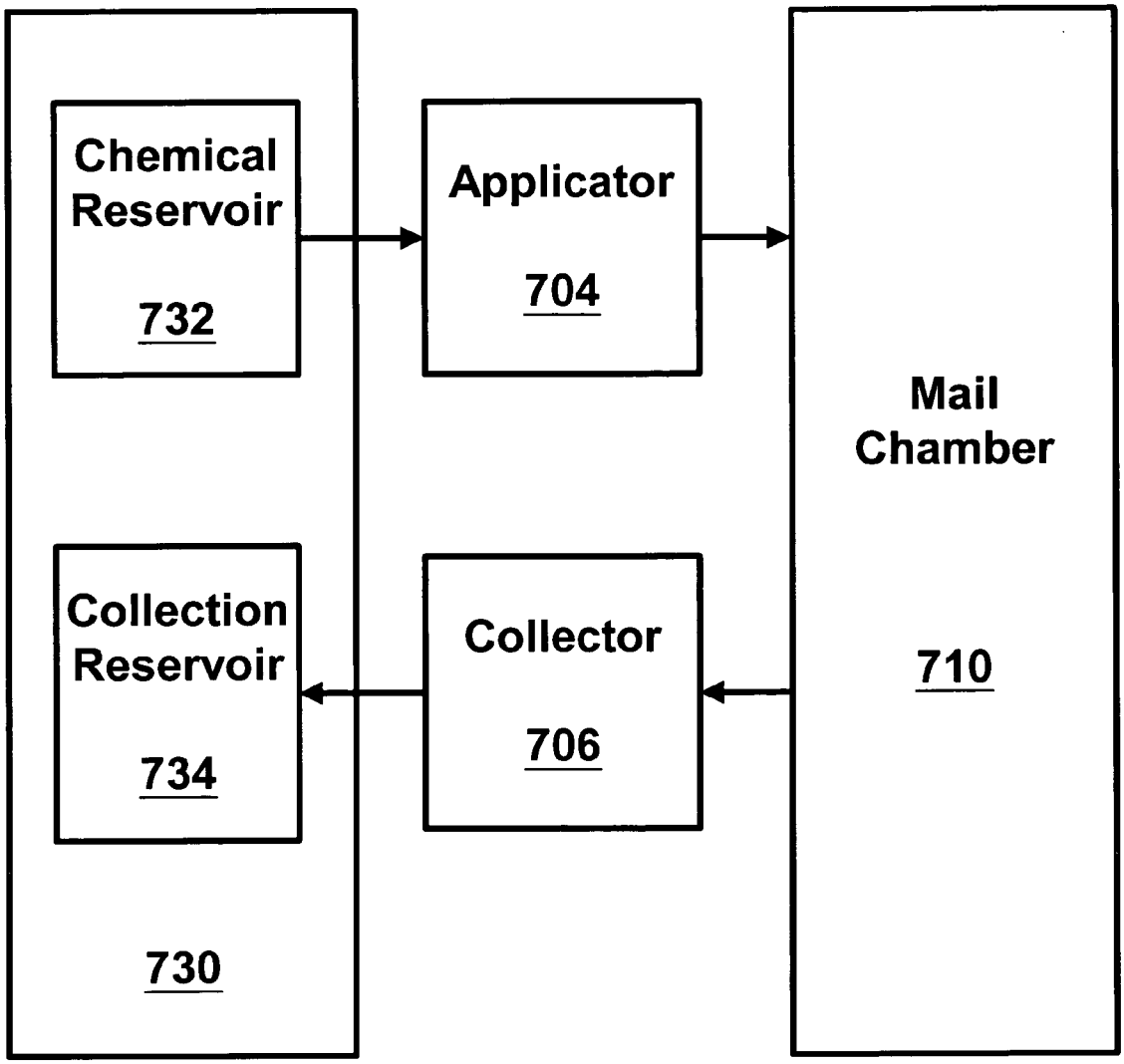
FIG. 7 is a diagram of a chemical processing system that may be integrated into an aspect of an embodiment of the present invention.

FIG. 7 is a diagram of a chemical processing system that may be integrated into a mailbox. A chemical reservoir 732 hold a chemical used to process the mail in a mail chamber 710. The chemicals may be drawn from the chemical reservoir 732 and applied to the inside of the mail chamber 710. Excess chemicals may be collected using a collector 706 and returned to a collection reservoir 734. In some implementations, the chemical reservoir 732 and collection reservoir 734 may be combined. In other implementations, the chemical reservoir 732 and collection reservoir 734 may be part of a chemical storage unit 730. Depending upon the chemical applied, it may not be necessary to have a collector 706 or collection reservoir 734. The applicator 704 may be as simple as an opening, or a complex application mechanism. Some application techniques assisted by the applicator mechanism include misting, gassing, or immersion.

Chemicals such as ozone or other non-thermal treatments may also be used to decontaminate mail. Ozone is a water-soluble naturally occurring gas, which is a powerful oxidizing agent. It is widely used to treat water. Gaseous ozone has long been used to control the growth of microorganisms on food. The use of gaseous ozone to directly treat (decontaminate) mail may also reduce pathogen numbers. In a gas treating implementation, the mail may be exposed to the gas for a fixed period of time. Gases such as ozone may be introduced to the chamber using methods similar to steam embodiments. Because some gas treatments may be implemented at ambient temperatures and pressures, their implementations may be relatively simple.

Some advantages of ozone over some other chemicals include simple applications such as fogging, convenience, lack of residues, reduced inhalation of disinfectant and rapid dissociation of gas after use. It is also equally effective on both horizontal and vertical surfaces unlike chemical fogging which is more effective on horizontal surfaces.

Treating Contaminants with Radiation

Electromagnetic radiation may be applied to contaminants inside a decontamination mailbox. The electromagnetic radiation may be any frequency between DC and light including microwave and x-ray frequencies. Different frequencies may produce different effects. For example, some frequencies, like DC and low frequency electromagnetic radiation may help clump contaminants. Once contaminates are clumped, they may become heavier and larger, making them easier to collect. Microwave frequencies may produce very rapid increases in surface temperature of mail located in the decontamination mailbox. This rapid increase in surface temperature may have the potential to decontaminate the mail from contaminates such as biological contaminates. The microwave heating may be cycled. For example, one cycle may heat the mail quickly for a short period of time, while another cycle may heat the mail to a lower temperature for a longer period of time. The cycle may be selected based on a tradeoff of the effect on the mail versus the reductions in pathogen numbers.

Figure 8:
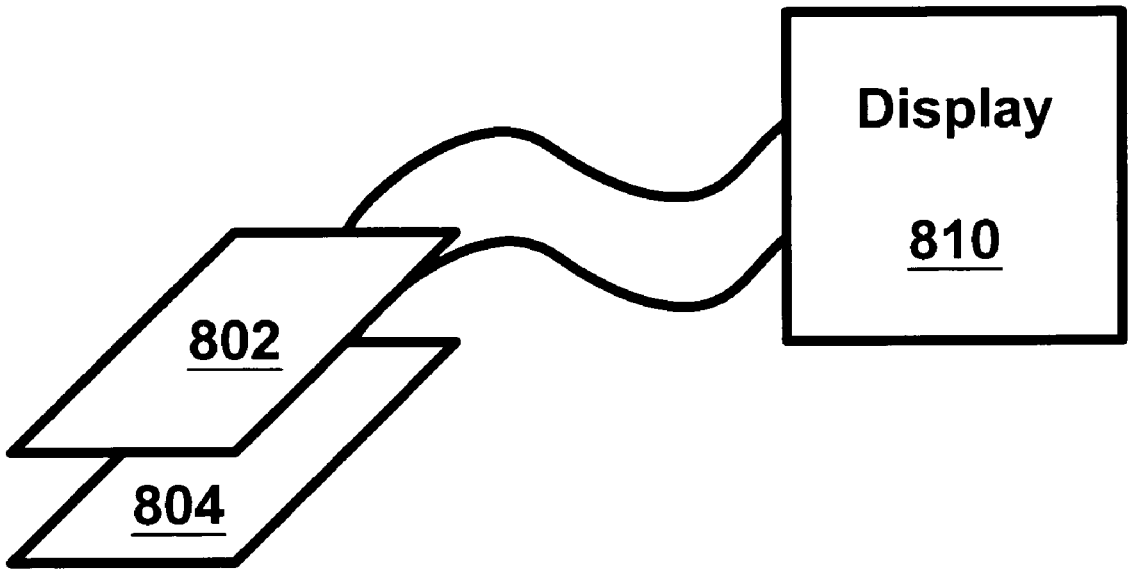
FIG. 8 shows a broad electromagnetic radiation application device as per an aspect of an embodiment of the present invention.

Electromagnetic radiation may be applied in a broad or focused manner. The electromagnetic radiation may also be applied in pulses or long durations exceeding several seconds. FIG. 8 shows a broad electromagnetic radiation application device as per an aspect of an embodiment of the present invention. A first radiation plate 802 and a second radiation plate 804 may be placed in or around a mail chamber. The radiation plates 802 and 804, may then be connected to a radiation source 810 which generates the electromagnetic potential used to treat the mail chamber.

Bacteria such as anthrax that are present in or on mail may be destroyed by irradiation treatment. Irradiation generally uses either gamma rays, electron beams or x-rays. Gammas rays generally require the use of a radioactive form of the element cobalt (Cobalt 60) or of the element cesium (Cesium 137). These substances give off high energy photons, called gamma rays, which may penetrate most mail. These particular substances do not give off neutrons, which means they do not make anything around them radioactive. This technology has been used routinely for more than thirty years to sterilize medical, dental and household products, and it is also used for radiation treatment of cancer. When not in use, the radioactive "source" may be stored down in a pool of water which absorbs the radiation harmlessly and completely. To irradiate mail, the source may be pulled up out of water into the mail chamber for a defined period of time. After the treatment is complete, the source may be returned to the water tank.

Electron beams, or e-beams, may also be used to irradiate mail. The e-beam is a stream of high energy electrons, propelled out of an electron gun. This electron gun apparatus may be a larger version of the device in the back of a TV tube that propels electrons into the TV screen at the front of the tube, making it light up. This electron beam generator may simply be switched on or off. No radioactivity is involved. Some shielding may be necessary to protect users from the electron beam.

X-ray irradiation may also be used to irradiate mail. To produce X-rays, a beam of electrons may be directed at a thin plate of gold or other metal, producing a stream of X-rays coming out the other side. Like cobalt gamma rays, X-rays may pass through mail, and may require shielding around the mail chamber for safety. However, like e-beams, the machine may be switched on and off, and no radioactive substances are involved.

The electromagnetic and irradiation radiation may be applied in pulses.

Treating Contaminants with Filtration

Figure 9:
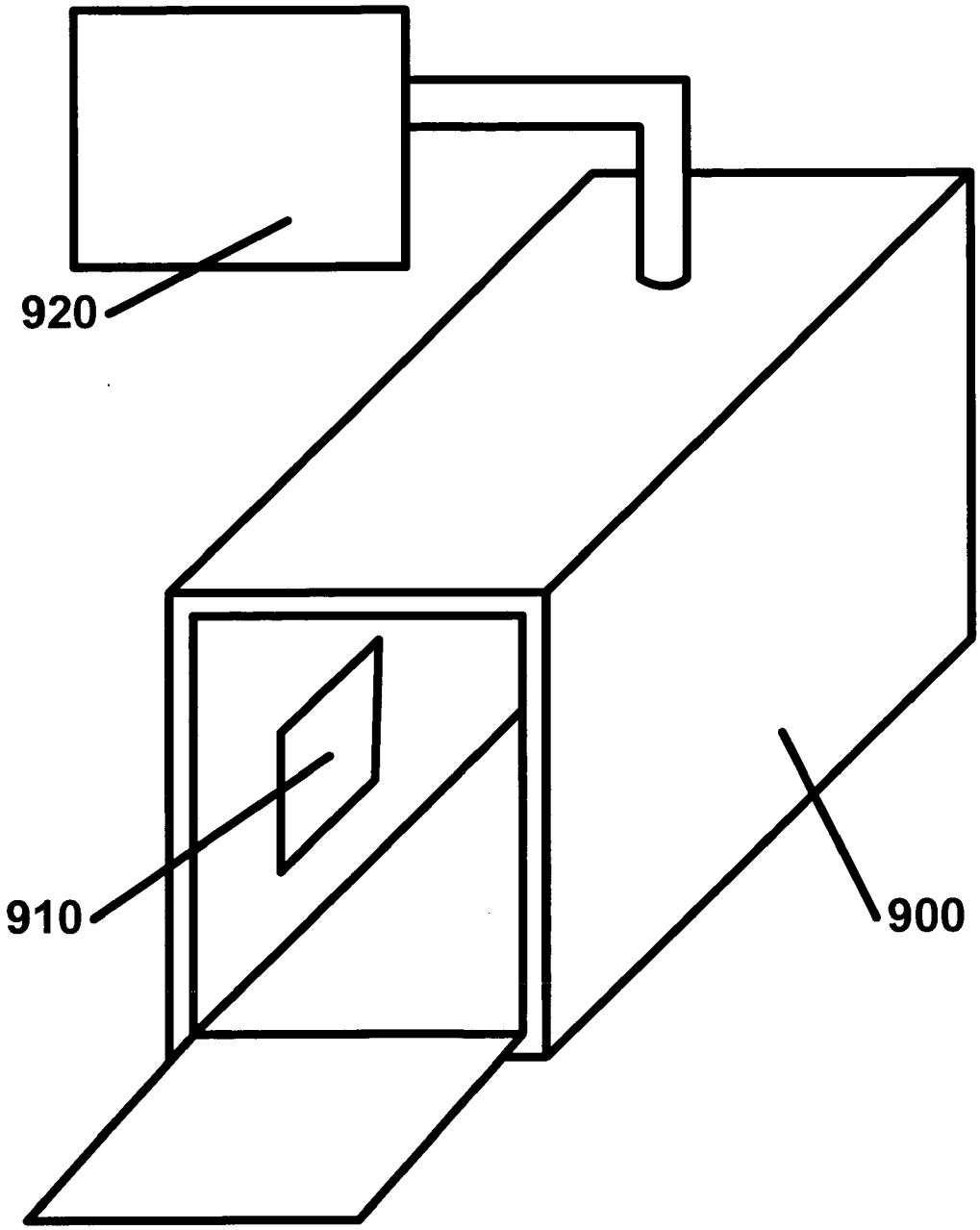
FIG. 9 shows an aspect of an embodiment of the present invention which uses filtration to remove contaminants from a mail chamber.

FIG. 9 shows an aspect of an embodiment of the present invention which uses filtration to remove contaminants from a mail chamber. A filter device 920 may be connected to an opening in a mail chamber 900 to suck contaminants from the air chamber 900. In some embodiments, an intake opening 910 may be provided. The filtration device may use a vacuum or fan to move the contaminants out of the mail chamber to be filtered. Any type of filter such as a HEPA filter, or no filter may be used. This method may be combined with any other decontamination method.

Control and Monitoring of Decontamination

Figure 10:
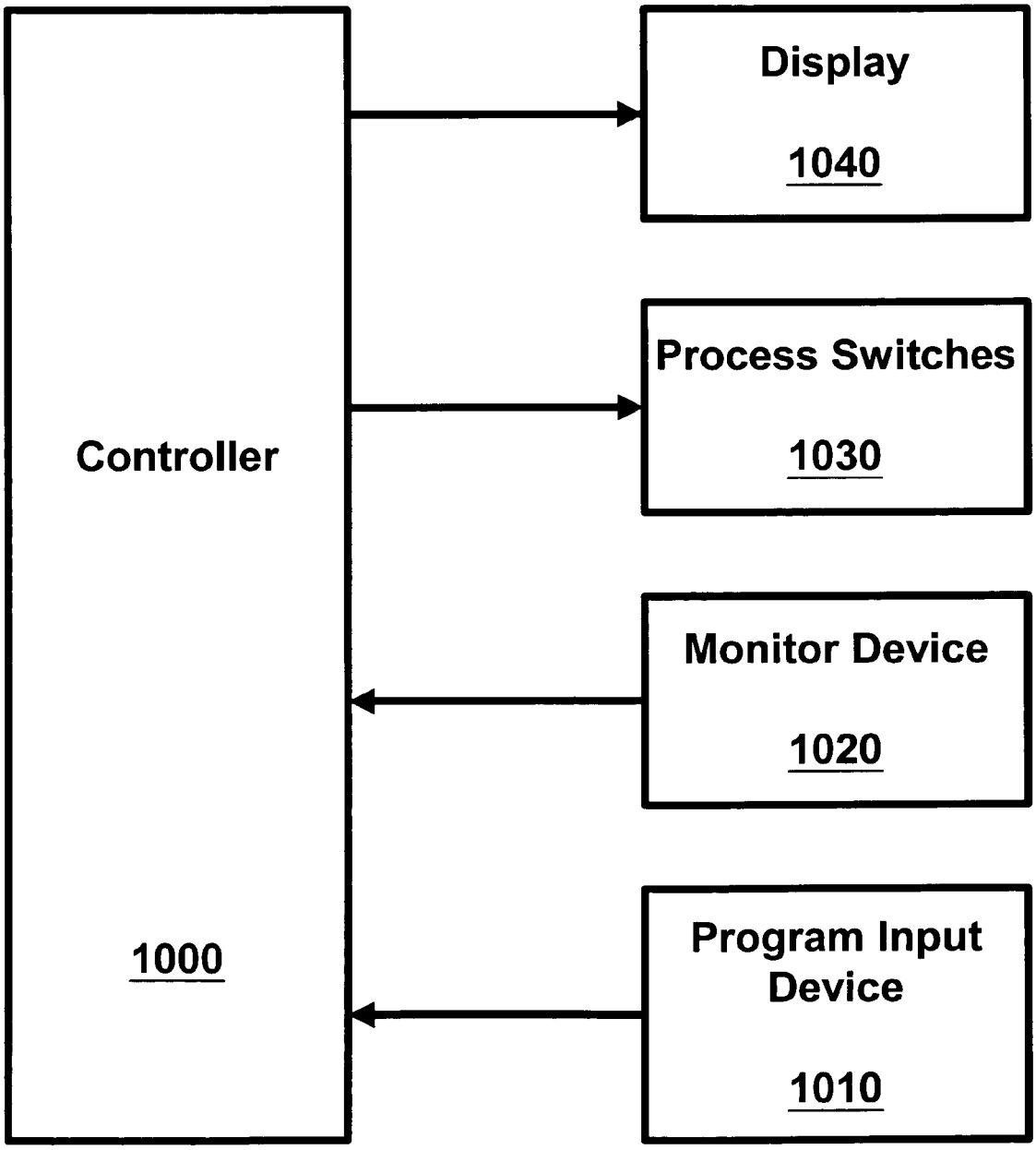
FIG. 10 shows a block diagram of a decontamination controller as per an aspect of an embodiment of the present invention.

Decontamination results may be improved by using a decontamination controller to control the decontamination process. A decontamination controller may be as simple as an on-off switch or a complex microprocessor based control unit. FIG. 10 shows a block diagram of a decontamination controller as per an aspect of an embodiment of the present invention. A main controller 1000 may be programmed through a program input device 1010. The program input device 1010 may be any input device such as switches, a PDA, personal computer, or a telephone. Programming parameters may include cycle times, and operation modes.

A monitor device 1020 may be any device or devices that assist in monitoring the decontamination process. These monitoring devices may include but are not limited to timers, temperature transducers, particle measurement devices, pressure transducers, flow rate transducers, door switches and radiation measurement devices. Process switches 1030 may be used by the controller to activate valves, turn on and off devices, activate door locks, or control any type of decontamination device. A display device 1040 may be used to provide feedback to a user of a decontamination mailbox. Feedback may include operational status, mode, decontamination status. Some decontamination controllers may only include some of these components. Other decontamination controllers may include more components. Decontamination controllers may be both mechanical and or electrical. Some decontamination mailboxes may have no decontamination controllers, and other decontamination mailboxes may have a multitude of decontamination controllers.

The foregoing descriptions of the preferred embodiments of the present invention have been presented for purposes of illustration and description. They are not intended to be exhaustive or to limit the invention to the precise forms disclosed, and obviously many modifications and variations are possible in light of the above teaching. The illustrated embodiments were chosen and described in order to best explain the principles of the invention and its practical application to thereby enable others skilled in the art to best utilize the invention in various embodiments and with various modifications as are suited to the particular use contemplated. For example, one skilled in the art will recognize that the present invention may used to decontaminate objects other than just mail. For example, a user of the present invention may wish to use the present invention to decontaminate objects purchased at stores by placing the object inside the present invention. Similarly, it is intended that any methods of decontamination may be used in practicing the present invention. For example, magnetic systems may also be used. Further, a dehumidifier which may deprive the biological agents of moisture may also be used as a decontamination device.

What is claimed is:

1. A safety mailbox system including:

a. a detachable mailbox; and b. a processing system, said processing system includes at least one decontamination mechanism;

wherein said detachable mailbox is positionable within said processing system and at least one of said at least one decontamination mechanism includes an optical lens.

2. A safety mailbox system according to claim 1, wherein a portion of said detachable mailbox is composed of a translucent material.

3. A safety mailbox system according to claim 2, wherein said translucent material passes ultraviolet light.

4. A safety mailbox system according to claim 1, wherein said optical lens is a fresnel lens.

5. A safety mailbox system according to claim 1, wherein at least one of said at least one decontamination mechanism includes an artificial light source.

6. A safety mailbox system according to claim 5, further including solar cells for use in powering said artificial light source.

7. A safety mailbox system according to claim 1, wherein said detachable mailbox includes a means for attaching said detachable mailbox to a detachable mailbox support.

8. A safety mailbox system according to claim 7, wherein said detachable mailbox support is a post.

9. A safety mailbox system according to claim 7, wherein said detachable mailbox support is a mounting plate.

* * * * *